US005281786A

United States Patent [19]

Park

[11] Patent Number: 5,281,786

[45] Date of Patent: Jan. 25, 1994

[54] METHOD OF CONTROLLING COOKING IN MICROWAVE OVEN USING SONIC DEVICE

[75] Inventor: Jong I. Park, Kyungsangnam, Rep. of Korea

[73] Assignee: Goldstar Co., Ltd., Seoul, Rep. of Korea

[21] Appl. No.: 957,380

[22] Filed: Oct. 7, 1992

[30] Foreign Application Priority Data

Oct. 12, 1991 [KR] Rep. of Korea ..... 17976/1991

[51] Int. Cl.[5] ..... H05B 6/68

[52] U.S. Cl. ..... 219/10.55 M; 219/10.55 B; 219/10.55 E; 99/325

[58] Field of Search ..... 219/10.55 M, 10.55 B, 219/10.55 E, 10.55 R; 99/451, DIG. 14, 325

[56] References Cited

U.S. PATENT DOCUMENTS

| | | | |
|---|---|---|---|
| 3,467,804 | 9/1969 | Smith | 219/10.55 B |
| 4,162,381 | 7/1979 | Buck | 219/10.55 B |
| 4,463,238 | 7/1984 | Tanabe | 219/10.55 B |
| 4,831,239 | 5/1989 | Ueda | 219/10.55 B |
| 4,870,238 | 9/1989 | Hodgetts et al. | 219/10.55 B |
| 4,952,766 | 8/1990 | McDonald | 219/10.55 B |

FOREIGN PATENT DOCUMENTS

| | | | |
|---|---|---|---|
| 2-93213 | 4/1990 | Japan | 219/10.55 C |
| 2-110215 | 4/1990 | Japan | 219/10.55 B |

*Primary Examiner*—Philip H. Leung

*Attorney, Agent, or Firm*—Birch, Stewart, Kolasch & Birch

[57] ABSTRACT

A method of controlling cooking in a microwave oven or an electronic cooking appliance, wherein the cooking can be performed at the optimum condition by sensing a sonic level through a sonic sensor in the case where the cooking is made utilizing a pressure container which produces a sound upon exhausting vapor therefrom. A temperature sensor is provided in addition to the sonic sensor. The heating control is performed to gratify both of the two conditions of the sonic sensor and temperature sensor. To avoid a mis-operation due to noises from a fan motor, a turntable motor and a magnetron, the fan motor, turn-table motor and magnetron are stopped temporarily. Under this condition, the sonic level is sensed once more and the heating control is performed on the basis of the once more sensed sonic level.

4 Claims, 4 Drawing Sheets

METHOD OF CONTROLLING COOKING IN MICROWAVE OVEN USING SONIC DEVICE

BACKGROUND OF THE INVENTION

1. Field of the invention

The present invention relates in general to a method of controlling cooking in a microwave oven or an electronic cooking appliance, and more particularly to a method of controlling cooking in a microwave oven wherein the cooking can be performed at the optimum condition by sensing a sonic level through a sonic sensor in the case where the cooking is made utilizing a pressure container which produces a sound upon exhausting vapor therefrom.

2. Description of Related Art

Referring to FIG. 1, there is shown a schematic diagram of a conventional microwave oven. As shown in this figure, the microwave oven comprises a turntable 3 disposed in a heating chamber 1 on the bottom thereof arranged to be rotatable about its own axis. An exhaust guide 7 is placed on the ceiling of the heating chamber 1 for exhausting vapor therethrough, gas or air generated in the heating chamber 1 to the outside of the microwave oven through driving of a fan by a fan motor 4. Provided in the exhaust guide 7 are a plurality of sensing devices 8, such as a humidity sensor, a temperature sensor and a gas sensor, for sensing a humidity, a temperature and amount of the exhaust gas in the heating chamber 1, respectively.

When the cooking is to be performed in the microwave oven with the above-mentioned construction, a container 2 containing a food therein is placed on the turntable 3 and is heated with rotation of the turntable 3. The exhaust gas or water vapor being generated from the food in the heating chamber I as the food is heated is exhausted through the exhaust guide 7 to the outside of the microwave oven. At this time, the plurality of sensing devices 8 provided in the exhaust guide 7 sense the humidity, the temperature and the amount of the exhaust gas in the heating chamber 1, respectively. In response to the sensed information, a controller (not shown) automatically controls the heating of the food and, therefore, the cooking thereof, according to the class of the food.

The conventional microwave oven has a disadvantage, in that it takes no notice of a characteristic of the container 2, particularly when the container 2 is a pressure container such as a pressure cooker. That is, in the case where the cooking of the food is to be performed utilizing the pressure container in the microwave oven, the cooking is controlled according to the information sensed by the plurality of sensors 8, similar to the case of utilizing a different container, without respect to the characteristic of the pressure container. Herein, although the microwave oven has been disclosed for illustrative purpose, those skilled in the art will appreciate that an electronic cooking appliance can control the cooking similar to that of the microwave oven. Noticeably, the "pressure container" is adapted to carry out the cooking of the food therein maintaining a desired pressure therein by vapor being generated when the food is heated and to produce a sound when the vapor is exhausted through an exhaust nozzle thereof when the internal pressure is above the desired pressure.

Since the pressure container such as the pressure cooker carries out the cooking of the food therein maintaining the internal pressure rising to the desired pressure, the cooking of the food therein can be performed by a smaller amount of heat as compared with a different container. For this reason, in the case where the cooking of the food is to be performed utilizing the pressure container in the microwave oven, the humidity, temperature and amount of the exhaust gas sensed in the exhaust guide 7 in the microwave oven are different from those of the case of cooking the same food utilizing a different container. In result, in the case where the cooking of the food is to be performed utilizing the pressure container in the microwave oven, the cooking of the food is not performed by heat an amount suitable to the pressure container, but performed by too much heat.

SUMMARY OF THE INVENTION

Therefore, the present invention has been made in view of the above problem, and it is an object of the present invention to provide a method of controlling cooking in a microwave oven wherein the cooking can be performed at the optimum condition by sensing a sonic level through a sonic sensor in the case where the cooking is made utilizing a pressure container which produces a sound upon exhausting vapor therefrom.

In accordance with the present invention, the above object can be accomplished by a provision of a method of controlling cooking in a microwave oven utilizing a pressure container which produces a sound upon exhausting vapor therefrom, comprising the steps of: heating the interior of a heating chamber upon start of the cooking; sensing a sonic level in the progress of the heating step, comparing the sensed sonic level with a predetermined reference value and performing repeatedly the above heating step if the sensed sonic level is below the predetermined reference value as a result of the comparison; if it is discriminated at the sonic level discriminating step that the sensed sonic level is above the predetermined reference value, sensing a temperature in the heating chamber, comparing the sensed temperature value with a predetermined reference value and performing repeatedly the above heating step if the sensed temperature value is below the predetermined reference value as a result of the comparison; if it is discriminated at the temperature discriminating step that the sensed temperature value is above the predetermined reference value, discriminating whether a fan motor, a turntable motor and a magnetron are on or off, stopping temporarily the fan motor, the turntable motor and the magnetron if it is discriminated that the fan motor, the turntable motor and the magnetron are at their on-states and then returning the operation to the sonic level discriminating step; and if it is discriminated at the temporarily stopping step that the fan motor, the turntable motor and the magnetron are at their off-states, completing the cooking of the food.

BRIEF DESCRIPTION OF THE DRAWINGS

The above and other objects, features and advantages of the present invention will be, more clearly understood from the following detailed description taken in conjunction with the accompanying drawings, in which.

DETAILED DESCRIPTION OF THE PREFERRED EMBODIMENTS

Figure 1:
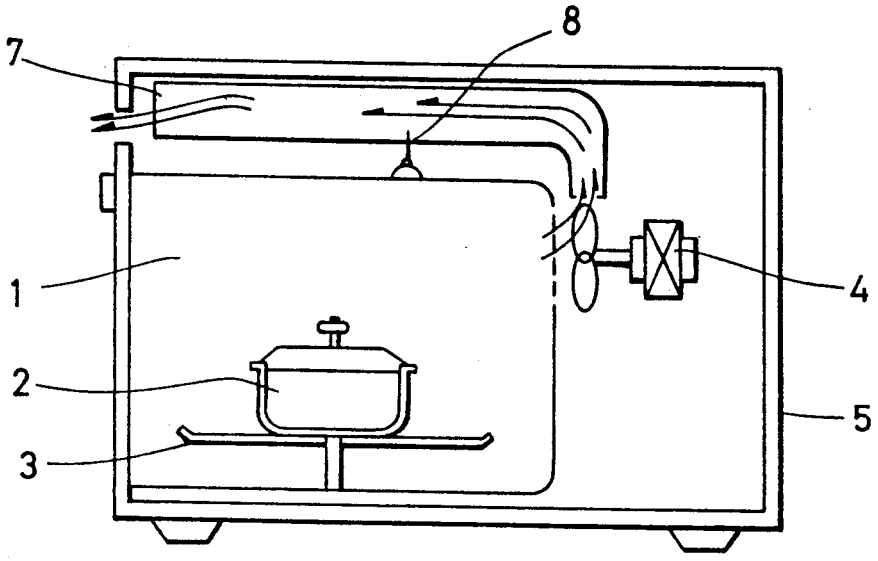
FIG. 1 PRIOR ART
FIG. 1 is a schematic diagram of a conventional microwave oven.
Figure 2:
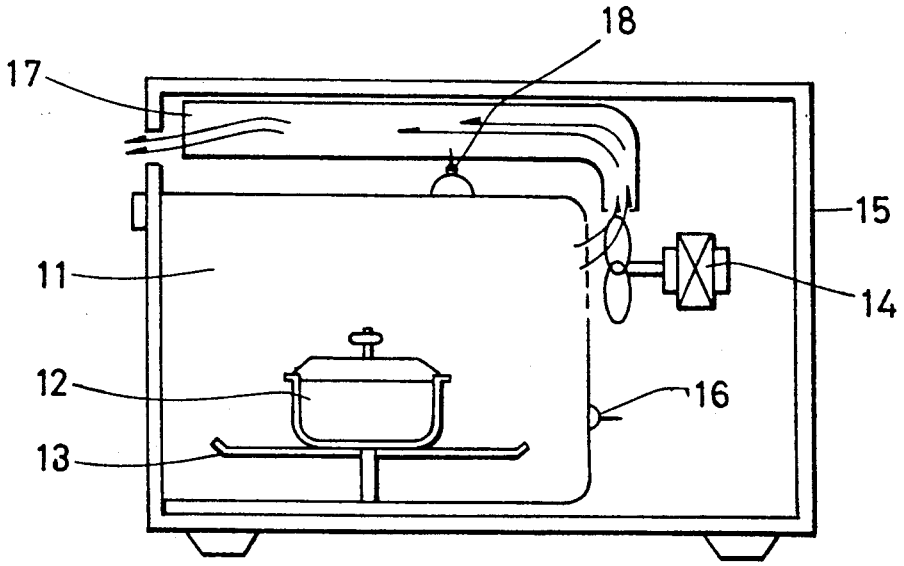
FIG. 2 is a schematic diagram of a microwave oven in accordance with the present invention.

Referring to FIG. 2, there is shown a schematic diagram of a microwave oven in accordance with the present invention. As shown in this figure, the microwave oven comprises a turntable 13 disposed in a heating chamber 11 on the bottom thereof and ar-ranged to be rotatable about its own axis. An exhaust guide 17 is placed on the ceiling of the heating chamber 11 for exhausting therethrough vapor, gas or air generated in the heating chamber 11 to the outside of the microwave oven through driving of a fan by a fan motor 14. Provided in the exhaust guide 17 are a plurality of sensing devices 18, such as a humidity sensor, a temperature sensor and a gas sensor, for sensing a humidity, a temperature and amount of the exhaust gas in the heating chamber 11, respectively. A sonic sensor 16 is placed on a side wall of the heating chamber 11 for sensing a sonic level. Also provided in a housing 15 of the microwave oven is an electric arrangement (see FIG. 3) comprising a microcomputer for automatically controlling cooking in response to output signals from the sensing devices 18 and to an output signal from the sonic sensor 16.

Figure 3:
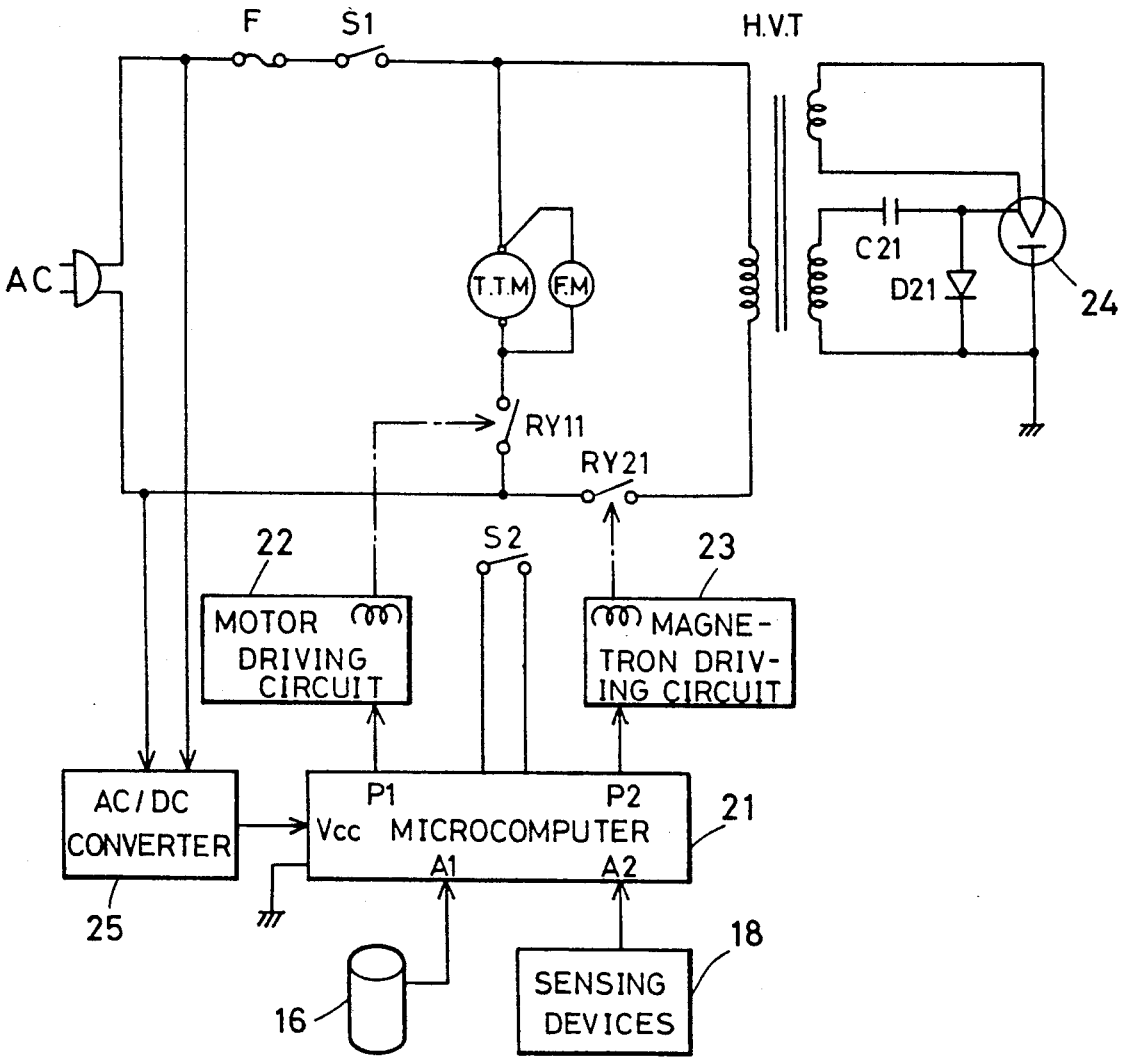
FIG. 3 is a block diagram of an electric arrangement of the microwave oven in accordance with the present invention.

Referring to FIG. 3, there is shown a block diagram of the electric arrangement of the microwave oven in accordance with the present invention. As shown in this drawing, an alternating current (AC) power is inputted through a fuse F and a primary safety switch S1 and then applied to motor driving relay and magnetron driving relay switches RY11 and RY21. The AC input power is fed to a turntable motor T.T.M. and a fan motor F.M. through the motor driving relay switch RY11. Also, the AC input power is fed to a primary coil of a magnetron driving high voltage transformer H.V.T. through the magnetron driving relay switch RY21. As a result, a voltage is induced in a secondary coil of the magnetron driving high voltage transformer H.V.T. and the induced voltage is applied as a drive voltage to a magnetron 24.

The AC input power is also fed to an AC/DC converter 25 which feeds a DC power to the microcomputer 21. The output signals from the plurality of sensing devices 18 and the output signal from the sonic sensor 16 are applied to the microcomputer 21. Also connected to the microcomputer 21 is a microwave oven door open sensing switch S2. The microcomputer 21 outputs a motor control signal at its output port P1 to control a motor driving relay RY1 in a motor driving circuit 22. In response to the motor control signal from the microcomputer 21, the motor driving relay RY1 controls the motor driving relay switch RY11. The microcomputer 21 also outputs a magnetron control signal at its output port P2 to control a magnetron driving relay RY2 in a magnetron driving circuit 23. In response to the magnetron control signal from the microcomputer 21, the magnetron driving relay RY2 controls the magnetron driving relay switch RY21.

Figure 4:
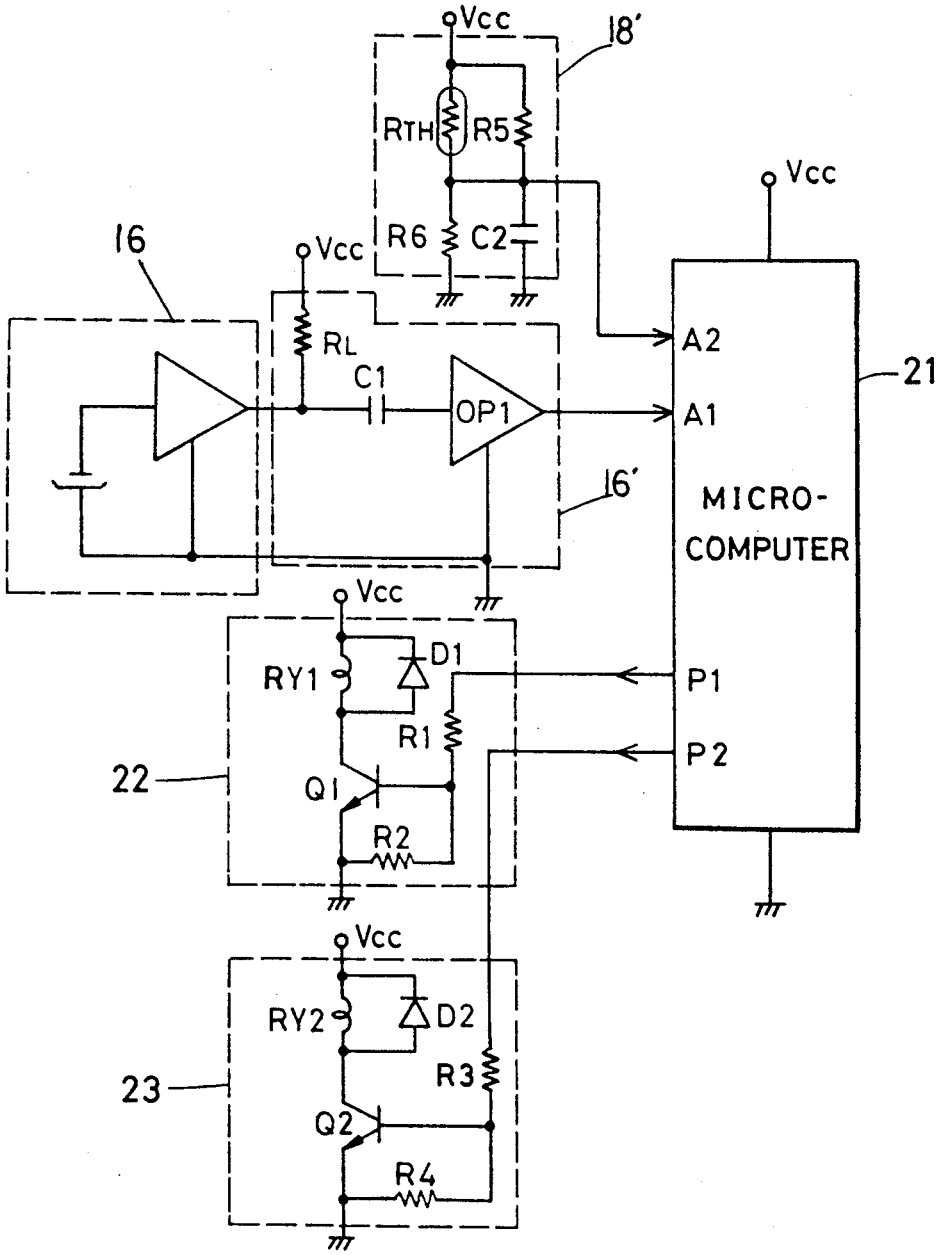
FIG. 4 is a circuit diagram of a heating control circuit of the microwave oven in accordance with the present invention.

Referring to FIG. 4, there is shown a circuit diagram of a heating control circuit of the microwave oven in accordance with the present invention. As shown in the drawing, a sonic level sensing circuit 16' is provided to input the sensed signal from the sonic sensor 16 through a resistor $R_L$ and a capacitor C1 thereof, amplify tile inputted signal through an amplifier OP1 thereof and output the amplified signal to an input port A1 of the microcomputer 21. A temperature sensing circuit 18' is provided to apply the sensed signal from a temperature sensing thermistor $R_{TH}$ to an input port A2 of the microcomputer 21 through resistors R5 and R6 and a capacitor C2 thereof. The motor driving circuit 22 includes resistors R1 and R2, a diode D1, the motor driving relay RY1 connected to the diode D1 and a transistor Q1 having its base for inputting the motor control signal from the output port P1 of the microcomputer 21 through the resistor R1. In response to the applied motor control signal, the transistor Q1 controls the motor driving relay RY1 connected to the diode D1. The magnetron driving circuit 23 includes resistors R3 and R4, a diode D2, the magnetron driving relay RY2 connected to the diode D2 and a transistor Q2 having its base for inputting the magnetron control signal f rom the output port P2 of the microcomputer 21 through the resistor R3. In response to the applied magnetron control signal, the transistor Q2 controls the magnetron driving relay RY2 connected to the diode D2.

In accordance with the preferred embodiment of the present invention, the sonic sensor 16 placed on the side wall of the heating chamber 11 senses a sonic level or a level of a sound which a pressure container 12 produces when vapor is exhausted through an exhaust nozzle thereof and the cooking can be controlled on the basis of the sensed sonic level.

The operation of the microwave oven with the above-mentioned construction in accordance with the present invention will hereinafter be described in detail.

When a cooking is Lo be performed in the microwave oven with the above-mentioned construction, the user puts the container 12 containing a food therein on the turntable 13 in the heating chamber 11 and pushes a cooking start key (not shown) to give a cooking start command to the microcomputer 21 Upon receiving the cooking start command, the microcomputer 21 rotates the turntable 13, drives the fan motor 14 and energizes the magnetron 24 to heat the interior of the heating chamber 11. The exhaust gas or water vapor being generated from the food in the heating chamber 11 as the food is heated is exhausted through the exhaust guide 17 to the outside of the microwave oven. At this time, the plurality of sensing devices 18 provided in the exhaust guide 17 sense the humidity, the temperature and the amount of the exhaust gas in the heating chamber 11, respectively. In response to the sensed information, the microcomputer 21 automatically controls the heating to the food and, therefore, the cooking thereof, according to the class of the food.

In the case where the cooking of the food is to be performed utilizing the pressure container in the microwave oven, the cooking of the food is performed in the same procedure as mentioned above and the heating to the food and, therefore, the cooking thereof are controlled on the basis of the sensed value of the sonic sensor 16. That is, if the sensed sonic level in the sonic sensor 16 exceeds a predetermined level under the condition that the interior of the heating chamber 11 is being heated by energization of the magnetron 24 under the control of the microcomputer 21, the microcomputer 21 stops the energization of the magnetron 24 to complete the cooking of the food.

Noticeably, there may be wanting in carrying out a proper cooking depending on the heating control information of only the sensed sonic level from the sonic sensor 16. In order to make up for this case, another heating control information may be obtained in addition to the sonic level and the heating control may be performed to gratify both of the two conditions. As a result, a proper cooking may be carried out depending on information from the two heating controls. The additional heating control information may be a sensed temperature value from the temperature sensing thermistor $R_{TH}$. Therefore, in accordance with the preferred embodiment of the present invention, the heating control is performed such that the sonic level and the sensed temperature value meet predetermined reference values, respectively.

Also in the case where the sonic sensor 16 senses a sound, it may be influenced by noises from the fan motor 14, the turntable 13 and the magnetron 24. For this reason, in accordance with the preferred embodiment of the present invention, the fan motor 14, the turntable 13, the magnetron 24 are caused to be stopped temporarily once a desired sonic level is sensed by the sonic sensor 16. Under this condition, the sonic sensor device 16 senses the sonic level once more. As a result, the heating control is performed on the basis of the sonic level sensed under the condition that the fan motor 14, the turntable 13, the magnetron 24 and etc. are stopped temporarily. Ultimately, the heating control can be performed without mis-operation due to a noise generated by the fan motor, turntable and magnetron.

Figure 5:
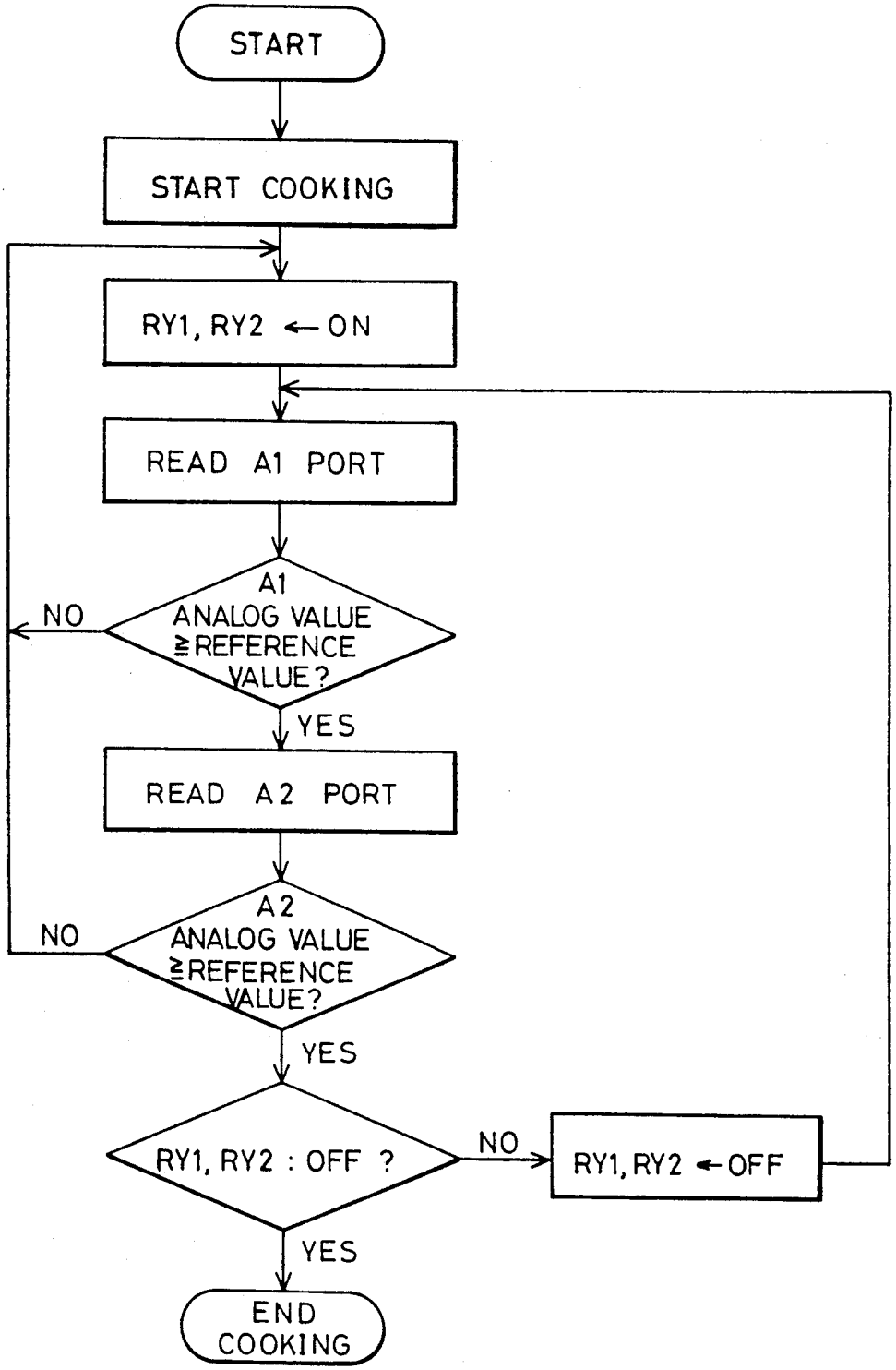
FIG. 5 is a flowchart illustrating an operation of controlling cooking in the microwave oven, in the case of utilizing a pressure container, in accordance with the present invention.

Referring to FIG. 5, there is shown a flowchart illustrating an operation of controlling the cooking in the microwave oven, in the case of utilizing the pressure container, in accordance with the present invention. Upon start of the cooking, there is first performed a heating step of turning on the motor driving relay RY1 to drive the turntable motor T.T.M. and the fan motor F.M. and turning on the magnetron driving relay RY2 to drive the magnetron 24, to thereby heat the interior of the heating chamber 11.

The food contained in the pressure container in the heating chamber 11 is cooked with the temperature thereof rising. A sound is produced from the pressure container when vapor is exhausted through the exhaust nozzle of the pressure container when the internal pressure of the pressure container is above the desired pressure.

At this time, the microcomputer 21 performs a sonic level discriminating step of reading a voltage value of the sensed sonic level from its sonic level input port A1, comparing the read voltage value with the predetermined reference voltage value and performing repeatedly the above heating step if the sensed sonic level is below the predetermined reference voltage value as a result of the comparison.

If it is discriminated at the sonic level discriminating step that the sensed sonic level is above the predetermined reference voltage value, the microcomputer 21 performs a temperature discriminating step of reading an analog level of the sensed temperature value from its sensed temperature signal input port A2, comparing the read analog level with the predetermined reference value depending on the internal temperature of the heating chamber 11 and performing repeatedly the above heating step if the sensed temperature value is below the predetermined reference value as a result of the comparison.

If it is discriminated at the temperature discriminating step that the sensed temperature value is above the predetermined reference value, the microcomputer 21 performs a relay temporarily stopping the step of discriminating whether the motor driving relay RY1 and the magnetron driving relay RY2 are at their off-states, turning off the motor driving relay RY1 and the magnetron driving relay RY2 if it is discriminated that the motor driving relay RY1 and the magnetron driving relay RY2 are at their on-states and then returning the operation to the sonic level discriminating step. This relay temporarily stopping step is performed for removing the surrounding noises, reading the sonic level once more and discriminating whether the once more read sonic level is above the predetermined reference value.

The off-states of the motor driving relay RY1 and the magnetron driving relay RY2, to be discriminated, mean that the sonic level and the temperature of the heating chamber 11 are above the predetermined values, respectively, under the condition of no surrounding noises after the relay temporarily stopping step. As a result, in this case, the microcomputer 21 performs a cooking completing step.

Herein, although the microwave oven has been disclosed for illustrative purpose in the preferred embodiment of the present invention, those skilled in the art will appreciate that an electronic cooking appliance can control the cooking similarly to that in the microwave oven. Also, although the heating and, therefore, the cooking have been completed when the sonic level and the temperature were above the predetermined reference values, the present invention is not limited thereto. In other words, when the sensed sonic level is above the predetermined reference value, the time may be counted such that the heating may be performed continuously for a predetermined period of time according to the class of the food, and then the cooking may be completed after the lapse of the predetermined period of time. Furthermore, as occasion calls, the cooking may be completed after the lapse of a steaming time period after the stop of the heating.

As hereinbefore described, according to the present invention, there is provided the method of controlling the cooking in the microwave oven or the electronic cooking appliance, wherein the cooking can be performed at the optimum condition by sensing the sonic level through the sonic sensor in the case where the cooking is made utilizing the pressure container which produces produce a sound when the vapor is exhausted through an exhaust nozzle thereof as the internal pressure is above the desired pressure.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of controlling cooking in a microwave oven, comprising the steps of:

generating microwave energy for cooking in said microwave oven;

selectively driving a fan and turntable with motors;

sensing a level of a sound which is produced from a container containing a food when vapor is exhausted from the container in progressive heating of the food and, consequently, cooking it; and controlling heating of the food on the basis of the sensed level of sound by the steps of temporarily stopping energization of said motors and heating means if the sensed level of sound is above a predetermined reference value, sensing the level of sound once more, and completing the cooking of the food if the once more sensed level of sound is above the predetermined reference value;

whereby cooking of the food can automatically be controlled.

2. The method of controlling cooking in a microwave oven, as set forth in claim 1, wherein the step of controlling the heating of the food on the basis of the sensed level of sound includes the steps of:

obtaining at least one heating control information in addition to the sensed level of sound as the heating control information, and controlling the heating to the food to satisfy both of the heating control information and the sensed level of sound.

3. The method of controlling cooking in a microwave oven, as set forth in claim 2, wherein the additional heating control information is a temperature value obtained by sensing the internal temperature of a heating chamber.

4. A method of controlling cooking in a microwave oven utilizing a pressure container which produces a sound upon exhausting vapor therefrom, comprising the steps of:

heating food within the interior of a heating chamber upon start of the cooking;

sensing a sonic level in the progress of the heating step, comparing the second sonic level with a predetermined reference value and performing repeatedly the above heating step if the sensed sonic level is below the predetermined reference value as a result of the comparison;

if it is discriminated at the sonic level comparing step that the sensed sonic level is above the predetermined reference value, sensing a temperature in the heating chamber, comparing the sensed temperature value with a predetermined reference value and performing repeatedly the above heating step if the sensed temperature value is below the predetermined reference value as a result of the comparison;

if it is discriminated at the temperature comparing step that the sensed temperature value is above the predetermined reference value, discriminating whether a fan motor, a turntable motor and a magnetron are on or off, stopping temporarily the fan motor, the turntable motor and the magnetron if it is discriminated that the fan motor, the turntable motor and the magnetron are at their on-states and then returning the operation to the sonic level discriminating step; and if it is determined at the temporarily stopping step that the fan motor, the turntable motor and the magnetron are at their off-states, completing the cooking of the food by turning off the magnetron.

* * * * *